US006491808B2

(12) United States Patent
Ichinose et al.

(10) Patent No.: US 6,491,808 B2
(45) **Date of Patent: *Dec. 10, 2002**

(54) ELECTROLYTIC ETCHING METHOD, METHOD FOR PRODUCING PHOTOVOLTAIC ELEMENT, AND METHOD FOR TREATING DEFECT OF PHOTOVOLTAIC ELEMENT

(75) Inventors: Hirofumi Ichinose, Tokyo (JP); Ippei Sawayama, Machida (JP); Tsutomu Murakami, Nara (JP); Masaya Hisamatsu, Kawasaki (JP); Yukie Ueno, Nara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,280

(22) Filed: Sep. 9, 1998

(65) Prior Publication Data

US 2001/0007306 A1 Jul. 12, 2001

(30) Foreign Application Priority Data

Sep. 11, 1997 (JP) ..... 9-246273

(51) Int. Cl.[7] ..... B23H 11/00; C25F 3/00; C25F 7/00; H05K 3/07

(52) U.S. Cl. ..... 205/646; 205/640; 205/666; 205/674

(58) Field of Search ..... 205/640, 646, 205/666, 674, 137, 147, 136, 118, 668, 686

(56) References Cited

U.S. PATENT DOCUMENTS

| | | | | | |
|---|---|---|---|---|---|
| 3,678,348 | A | * | 7/1972 | Reber et al. | 257/773 |
| 4,247,377 | A | * | 1/1981 | Eckler et al. | 205/658 |
| 4,419,530 | A | | 12/1983 | Nath | 136/251 |
| 5,139,624 | A | * | 8/1992 | Searson et al. | 205/656 |
| 5,277,786 | A | * | 1/1994 | Kawakami | 205/124 |
| 5,476,575 | A | * | 12/1995 | Brophy et al. | 205/652 |
| 5,501,787 | A | * | 3/1996 | Bassous et al. | 205/124 |
| 5,863,412 | A | * | 1/1999 | Ichinose et al. | 205/652 |
| 5,993,637 | A | | 11/1999 | Hisamatsu et al. | 205/652 |
| 6,033,548 | A | * | 3/2000 | Akram et al. | 204/212 |
| 6,132,583 | A | * | 10/2000 | Stone | 204/230.2 |

FOREIGN PATENT DOCUMENTS

| | | |
|---|---|---|
| JP | 55-108779 | 8/1980 |
| JP | 62-290900 | 12/1987 |
| JP | 10-158900 | 6/1998 |

* cited by examiner

*Primary Examiner*—Nam Nguyen
*Assistant Examiner*—Wesley A. Nicolas
(74) *Attorney, Agent, or Firm*—Fitzpatrick, Cella, Harper & Scinto

(57) ABSTRACT

An electrolytic etching method for etching treating an object to be etched by an electrochemical reaction through an electrolyte between the object to be etched and an etching electrode, where the contact angle of the electrolyte to the object to be etched is not more than 70°. This electrolytic etching method can etch the object in a non-contact manner, can reduce the cost, number of steps, and processing time, and can enhance the patterning accuracy.

19 Claims, 4 Drawing Sheets

ELECTROLYTIC ETCHING METHOD, METHOD FOR PRODUCING PHOTOVOLTAIC ELEMENT, AND METHOD FOR TREATING DEFECT OF PHOTOVOLTAIC ELEMENT

BACKGROUND OF THE INVENTION

1. Field of the Invention

The present invention relates to a method for carrying out partial etching or pattern etching through the use of an electrolytic reaction and to a method for producing a photovoltaic element and a method for treating a defect of a photovoltaic element, using the foregoing method.

2. Related Background Art

Hitherto, as a method for etching a metal or a transparent conductive film, there has been employed the chemical etching method such as disclosed in, for example, Japanese Patent Application Laid-Open No. 55-108779, U.S. Pat. No. 4,419,530, and so on. This is a method for first forming a positive pattern by silk screen printing or by a photoresist and thereafter treating the metal or the transparent conductive film corresponding to negative portions (exposed portions) with an etchant such as ferric chloride solution or nitric acid.

However, the chemical etching method necessitates such treatments as application of a resist onto an object to be etched (simply referred to as "etching object") and removal of the resist, which complicates the steps and increases the operation cost. In addition, the chemical etching method required long operation time for some types of etching objects because of its low reaction rate. Further, the chemical etching method did not permit a non-contact process and thus had another problem that the yield was low.

On the other hand, for carrying out the partial etching or patterning by use of an electrolytic reaction, the electrolytic etching was conducted after a pretreatment of application of a resist to an etching object, followed by exposure and hardening to obtain a pattern. In this case, the resist used needs to be removed after the etching. For example, Japanese Patent Application Laid-Open No. 62-290900 discloses a method for making a resist pattern in close contact with an electroconductive film, immersing it in an aqueous solution of hydrochloric acid, supplying an electric power to pattern the film in the other portions than the resist, and removing the resist, thereby completing the etching. Specifically, it discloses using flat plate electrodes as counter electrodes and performing an electrolytic treatment by a power source in an electrolyte to form a desired pattern in the etching object.

However, although this method permits the non-contact process during electrolysis, it also requires the pretreatment of application of the resist and the posttreatment of removal of the resist as the chemical etching does. Therefore, this method also has the problems of the impracticability of perfect non-contact process in the pretreatment and in the posttreatment, the incapability of curtailing the operation cost, the large number of steps, and lowering in the yield. It has another problem that if bubbles formed during electrolysis stay on the resist pattern, patterning can not be carried out precisely.

Further, as a method free from the pretreatment of the resist pattern on the etching object, Japanese Patent Application Laid-Open No. 5-93300 discloses a method for putting a probe electrode into a capillary having an aperture at the tip, placing a small gap between the peripheral surface of this tip aperture and a solid surface of a work as a working electrode, and carrying out electrolysis while allowing the electrolyte to flow through the tip aperture.

However, although this method permits the non-contact patterning process of the etching object without the pretreatment, it has a problem of difficult pattern control due to spread of the solution in the in-plane direction because the method is a pinpoint etching technique. Further, this method has another problem of rounding of edge portions and longer operation time when applied to patterning in a wide area. In addition, the amount of gas generated during electrolysis becomes large depending upon the kind of the etching object or the electrolyte, and the gas generated in the early stage of reaction stays in the form of bubbles between the etching object and the electrode. Therefore, since the electrolytic reaction is inhibited in the portions where the bubbles stay, there arises a problem that disconnection or chipping of a patterning line occurs.

An object of the present invention is to provide an electrolytic etching method capable of solving the problems of the prior art and etching an etching object in a non-contact manner, at low cost, in the reduced number of steps, in reduced operation time, and with enhanced patterning accuracy.

SUMMARY OF THE INVENTION

The inventors have extensively and intensively studied the etching methods utilizing reduction, oxidation, and dissolution phenomena by an electrochemical reaction of a metal or a transparent conductive film, found out conditions for enhancing the etching accuracy, and accomplished the present invention by further detailed analysis of the knowledge obtained by the inventors on the etching method permitting the stable treatment over a long period without such an adverse effect as peeling off.

The gist of the invention is that the etching treatment is carried out by an electrochemical reaction between the etching object and the etching electrode and the contact angle of the electrolyte to the etching object is not more than 70° during execution of patterning, whereby influence of the bubbles generated during electrolysis can be controlled. As a result, the problem of defective etching including the disconnection and chipping of patterning line is overcome. Further, the present method can also be applied to fabrication of photovoltaic elements, so that photovoltaic elements can be fabricated with good characteristics, in a high yield, and with high reliability.

The present invention has been accomplished based on these findings, and the operation of the present invention will be described below.

The surface tension of the electrolyte is lowered and the contact angle of the electrolyte to the etching object is adjusted to not more than 70°, preferably to 10°–70°, whereby it is possible to prevent the phenomenon that the gas is generated in a large volume by the electrolytic reaction and forms a large bubble, which stays, and whereby it is also possible to prevent the phenomenon that the bubbles instead become so small as to be easy to cohere and a cohering body of the bubbles stays.

When the electrochemical reaction is allowed to take place between the etching object and the etching electrode, lowering the surface tension of the electrolyte can break or inhibit the bubbles of the generated gas, whereby it is possible to control staying (or residence) of a large bubble somewhere between the etching object and the electrode. As a result, it becomes possible to effectively carry out the electrolytic etching.

When an additive is added in an amount of 0.01%–10% of the total weight of the electrolyte, excellent patterning by electrolytic etching can be performed without hindering the electrolytic reaction while controlling the residence of bubbles.

By adding to the electrolyte at least one selected from polyethylene glycol, polypropylene glycol, acetylenic alcohol, ethanol, and copolymers thereof, and surfactants, as a substance for lowering the surface tension, the surface tension can effectively be lowered. As a result, the residence of bubbles can be inhibited.

By combining the electrolytic etching treatment with patterning processing, the processing can be performed at a high treating rate without being affected by the temperature of the treating solution or the like.

Combining the electrolytic etching with mask etching enables patterning including a curved line or the like.

Forming the etching electrode in a desired etching pattern enables non-contact patterning.

When the electrolyte contains a Lewis acid or a Lewis base, they serve as a carrier of charge by the electron-pair transfer, so that the electrolytic reaction can be promoted without generating many hydrogen ions, whereby generation of the bubbles posing the problem upon etching can be reduced.

When an aqueous solution is used as the electrolyte, the electrolyte is less volatile and thus the sequential steps can be performed readily with little affection by vaporization or the like.

Allowing a direct current, a pulse current, or an alternating current to flow between the etching electrode and the etching object becomes it possible to control the line width and the treatment time.

By effecting washing with water and thermal treatment of the etching object after the etching treatment, the additive is prevented from reacting with the etching object, so that the adverse effect such as peeling off will not occur.

By using as the etching object a substrate on which a transparent conductive film is deposited, the electrolytic etching of the present invention can be applied to fabrication of various devices including solar cells, photosensitive devices, light-emitting devices, liquid-crystal displays, and so on.

By using as the etching object a substrate for a photovoltaic element having at least one of a metal layer and a transparent conductive film thereon, precise patterning is achieved with accuracy, whereby a photovoltaic element can be obtained with excellent appearance, characteristics, and reliability.

By using as the etching object a photovoltaic element having a semiconductor layer provided on a substrate and an electroconductive layer provided on the semiconductor layer, etching can be achieved with high accuracy, so that a photovoltaic element can be produced with high performance.

By reducing a conductive layer in the periphery of a short-circuit path by the electrolytic etching method of the present invention, the conductive layer on the short-circuit path can be selectively etched, whereby the performance of the photovoltaic element can be restored.

DESCRIPTION OF THE PREFERRED EMBODIMENTS

The embodiments of the present invention will be described below.

(Patterning Processing)

The electrolytic etching method of the present invention will be described with an example of patterning processing.

In the electrolytic etching method of the present invention, a variety of electrolytes can be used, the reaction proceeds at room temperature, and no heat needs to be supplied from the outside. During electrolysis, the components of the etching object are ionized by a reduction or oxidation reaction to dissolve in the electrolyte at the same time as the generation of a gas.

For patterning by the electrolytic etching, there are a method for applying a resist onto an etching object to form a mask and etching a portion without the mask, and a method for preliminarily forming the electrode side in a shape for patterning and controlling electric lines of force to form desired patterning lines.

Figure 1A:
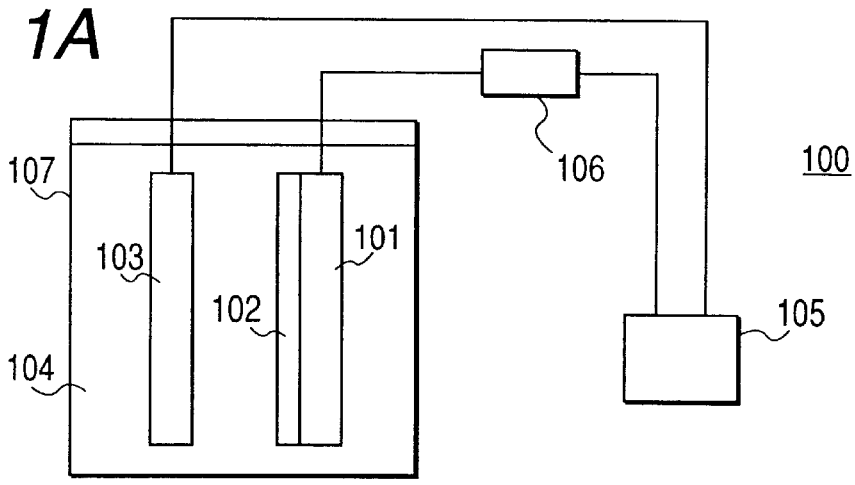
FIGS. 1A, 1B and 1C are schematic views showing the electrolytic etching apparatus according to the present invention.

FIG. 1A illustrates a method for carrying out the electrolytic etching of an etching object with a mask formed thereon. In the drawing, reference numeral 101 designates the etching object, 102 the mask, 103 the etching electrode, 104 the electrolyte, 105 a power source, 106 a controller for controlling conditions including the voltage, current, time, etc., and 107 an electrolytic cell. In this method only the non-masked portion can undergo etching patterning by the electrolysis reaction.

Figure 1B:
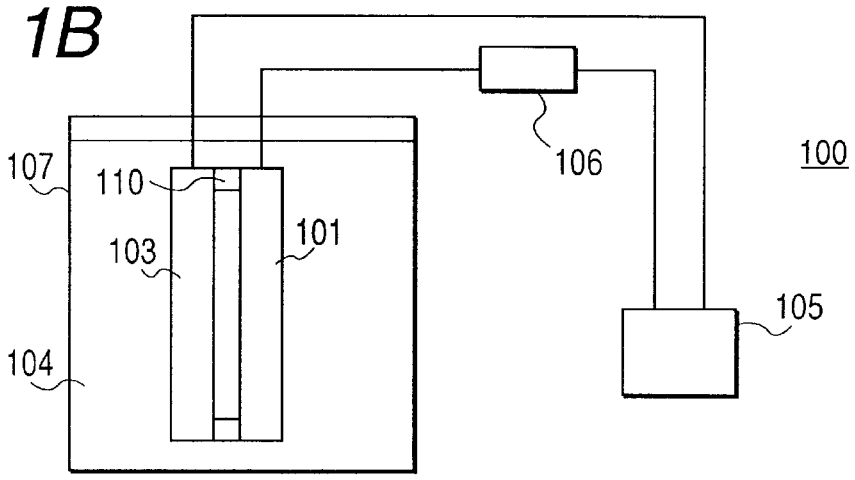

FIG. 1B illustrates a method for carrying out the electrolytic etching with the patterned electrode and with a gap provided. In this method, the etching electrode 103 is provided with gap members 110 obtained by patterning cutting of a 1 mm-thick silicone rubber sheet.

Figure 1C:
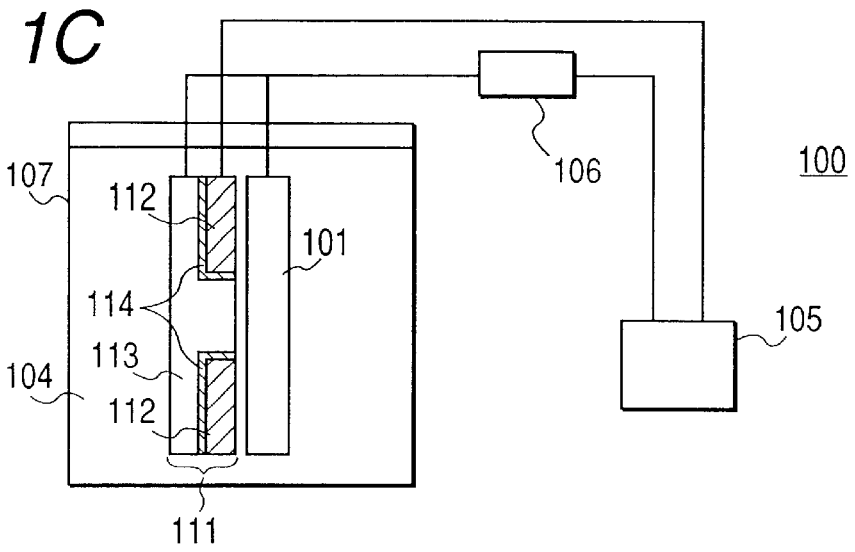

FIG. 1C illustrates a method for carrying out the electrolytic etching while controlling the electric lines of force with the patterned electrode having an auxiliary electrode further formed therein. The etching electrode 111 has a work electrode 112 and an auxiliary electrode 113, each electrode forming a pattern. An insulating material 114 is provided between the work electrode 112 and the auxiliary electrode 113.

There are no specific restrictions on the electric current flowing between the etching electrode and the etching object, but the electric current can be suitably selected from the direct current, the pulse current, and the alternating current, which preferably enables control of line width and control of treatment time and is thus preferred.

It is preferable to carry out the washing with water and the thermal treatment of the etching object after completion of the etching treatment, which prevents a substance contained in the electrolyte from remaining on the etching object and reacting therewith. Particularly, when the etching object is a composite multilayered film, the adverse effect such that a part of the layer are eroded to be peeled off can preferably be avoided.

There are no specific restrictions on the etching object, but examples of the etching object include a substrate on which a transparent conductive film is deposited, a substrate for a photovoltaic element having at least one of a metal layer and a transparent conductive film, a photovoltaic element having at least a semiconductor layer provided on a substrate and a transparent electrode layer provided on the semiconductor layer, and so on.

Hitherto, in either one of the methods shown in FIGS. 1A to 1C, the gas evolving during the electrolytic etching formed bubbles, which partly stayed.

In the method of FIG. 1A, the bubbles stay at the edge of the mask 102 formed on the etching object 101. In this case there is a possibility that uniformity may be not achieved before the completion of etching because of the influence of the bubbles generated in the early stage of the etching.

In the methods of FIGS. 1B and 1C, there is a possibility that the bubbles may stay on the patterned electrode side, which is fatal.

Specifically, in the method of FIG. 1B, when after completion of etching of an etching object by the electrolytic reaction another etching object is subsequently etched, the bubbles stay in the portion of the gap between the patterned portion of the electrode 103 and the gap member 110. That is, since the bubbles stay between the etching electrode 103 and the etching object 101, the electrochemical reaction will not proceed there, which results in formation of nonuniform patterning lines and may cause disconnection of a line if many bubbles stay. The influence of this phenomenon becomes outstanding with increasing number of etching treatments because of accumulation in amount of staying bubbles.

In the method of FIG. 1C, the bubbles stay on the etching electrode side as is the case with FIG. 1B. When the bubbles stay to adhere to the portion of the work electrode 112, the electric lines of force can not be controlled in the desired pattern, so that formation of nonuniformity patterning lines and occurrence of disconnection will be caused. In either case, removal of the bubbles by an ultrasonic wave generator, circulation of the solution, a wiper, or the like is available, but the effect thereof may be insufficient depending on the amount of generated gas. Further, the more complex the pattern, the stronger the tendency that the bubbles stay at the edge portion (corner) of the pattern.

According to the present invention, it becomes possible to inhibit or prevent the residence of bubbles resulting from the gas generated during the electrolytic reaction, which is the problem as described above.

In the electrolytic etching method of the present invention, the contact angle of the electrolyte to the etching object is not more than 70°, preferably 10°–70°. When the contact angle of the electrolyte to the etching object is not more than 70°, the surface tension of the electrolyte is low enough to reveal the antifoaming property. When the contact angle is not less than 10°, the phenomenon is prevented in which fine bubbles flock together to cohere and the cohering body gradually stay, whereby stable patterning can be carried out continuously.

It is preferred that the electrolyte contains an additive substance (additive) for lowering the surface tension. The addition of the additive is preferable in that the electrolyte comes to have the bubble-breaking property to break bubbles once generated and the bubble-inhibiting property to inhibit generation of bubbles in the electrolyte.

The content of the additive is preferably 0.01–10% by weight of the whole of the electrolyte in order to maintain the effect stably without hindering the electrochemical reaction.

When the additive selected is one having a high spreading property (dispersing property) into the electrolyte and a small surface tension, the bubble-breaking property can be demonstrated. When the additive selected is one having a small solubility in the electrolyte and a small surface tension, the bubble-inhibiting property can be demonstrated. In other words, a more effective additive has a smaller surface tension, a higher spreading property (dispersing property), and a smaller solubility.

When the electrolyte used is an acid or a base, or an aqueous solution thereof, it is necessary to select the additive. The additive effective for the aqueous solution includes antifoaming agents of the alcohol type, the silicone type, the amide type, the fatty acid ester type, the phosphate type, and the metallic soap type, which also include substances called surfactants. These antifoaming agents are used alone or as a mixture system of two or more out of them, and the form thereof may be either solid or liquid. However, one of the liquid form with a higher solubility is desired with consideration to the influence of the additive remaining on the etching object in the posttreatment after the electrolytic treatment.

Further, for treating a semiconductor element such as a substrate for photovoltaic elements, it is necessary that the additive does not remain on the surface of the substrate. This is because, in the case of the composite multilayered film, the residual additive may pose such a problem that a part of the layer is eroded to cause peeling off.

Specifically, an effective additive is at least one selected from the group consisting of polyethylene glycol, polypropylene glycol, acetylenic alcohol, ethanol, copolymers thereof, and surfactants. Among them, polyethylene glycol and polypropylene glycol are preferred because they have a low volatile property and is therefore not vaporized to lose the effect during the electrolytic treatment even when carrying out a continuous treatment over a long term.

Here, the electrolyte is a medium for inducing the electrochemical reaction. There are no specific restrictions on the electrolyte, but there can be used ones obtained by dissolving an electrolyte such as an acid or a base, or a salt thereof, in a nonaqueous, organic solvent of the alcohol type, the phenol type, or the like, or in water.

Here, it is also preferred that the electrolyte contains a Lewis acid or a Lewis base to serve as a carrier of charge by the electron-pair transfer. This can promote the electrolytic reaction without generating a lot of hydrogen ions and can in turn reduce the generation of bubbles posing the problem upon etching. As the Lewis acid and the Lewis base added to the electrolyte, there are used ones obtained by dissolving in a solvent, an acid or a base such as sulfuric acid, nitric acid, hydrochloric acid, ammonia, etc., or a salt such as sodium chloride, potassium chloride, aluminum chloride, zinc chloride, tin chloride, ferric chloride, sodium nitrate, potassium nitrate, etc.

Further, when the electrolyte is an aqueous solution of the acid or the base, or the salt as described above, the electrolyte is less volatile and is thus less prone to affection such as vaporization or the like, which preferably enables sequential steps to be carried out easily.

(Production of Photovoltaic Element)

A photovoltaic element can be produced by etching a conductive layer provided on the semiconductor layer such as a transparent electrode layer or the like, by the electrolytic etching method of the present invention.

Figure 3:
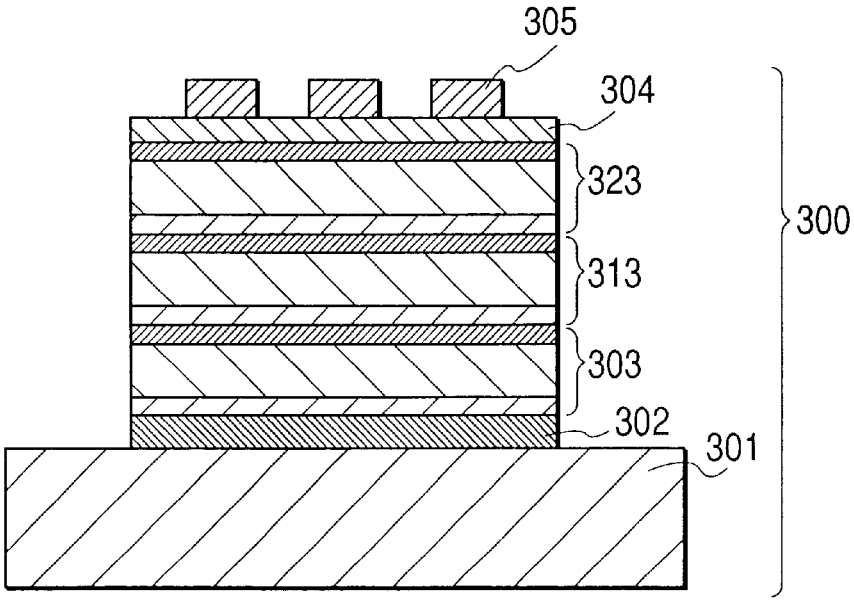
FIG. 3 is a schematic, sectional view diagrammatically showing an example of a solar cell produced according to the present invention.

An example of the photovoltaic element that can be produced according to the present invention is illustrated in FIG. 3. FIG. 3 illustrates an amorphous solar cell 300, and the solar cell 300 has a plurality of semiconductor layers 303, 313, and 323 each having an n-i-p junction to generate a flow of electric current in response to absorption of incident light. Numeral 303 denotes a bottom cell, 313 a middle cell, and 323 a top cell. Numeral 301 represents a substrate for supporting the solar cell body, 302 a lower electrode layer, 304 a transparent electrode layer, and 305 a grid electrode used as a collector electrode. FIG. 3 illustrates an amorphous silicon based solar cell upon which the light is incident from the side opposite to the substrate side, but it should be noted that the photovoltaic elements that can be produced according to the present invention are not limited to those of specific structure or configuration.

Each of the components will be described below.

<Substrate 301>

The substrate 301 is a substrate for mechanically supporting the semiconductor layers 303, 313, 323 in the case of the solar cell of the multilayered structure of thin films of amorphous silicon or the like and may also be used as an electrode in some cases. As the substrate, there are used electrically conductive substrates, for example, a metal member such as a stainless steel substrate, a tin metal foil, etc., an electrically insulating substrate such as of glass, plastics, etc., or one obtained by depositing an electroconductive film on at least a part of an electrically insulating substrate.

<Lower Electrode Layer 302>

The lower electrode layer 302 is one of the electrodes for leading out the power generated in the semiconductor layers 303, 313, 323. When an electrically conductive substrate is used as the substrate 301, the lower electrode layer 302 is not essential. The lower electrode layer 302 is required to have such a work function as to be in ohmic contact with the semiconductor layer 303. The surface of the lower electrode layer may be textured to bring about irregular reflection of light, thereby increasing Jsc.

As the material for the lower electrode layer 302, there are used, for example, metals or alloys such as Al, Ag, Pt, ZnO, $In_2O_3$, ITO (indium tin oxide), AlSi, etc., transparent conductive oxides (TCO), and so on.

As the method for producing the lower electrode layer 302, there can be used the methods such as plating, evaporation, sputtering, and so on.

Here, it is important for improving the characteristic of the photovoltaic element that the lower electrode layer 302 contains a metal layer or a metal alloy layer with a high electric conductivity and with a high reflectivity. However, if the metal layer is stacked directly on the semiconductor layer 303, they could be alloyed at the interface therebetween to increase the series resistance. Therefore, a structure is preferably used in which the metal layer or the metal alloy layer, and a transparent conductive oxide layer are stacked in this order on the substrate 301.

<Semiconductor Layers 303, 313, 323>

As the semiconductor layers, when the case of an amorphous silicon based solar cell is taken, there are included the so-called Group IV type and Group IV alloy type amorphous silicon semiconductors such as a-Si, a-SiGe, a-SiC, and so on, as the material for forming the i-layers. The semiconductor materials for forming the p-layers or the n-layers are obtained by doping the semiconductor materials for forming the i-layers as described above with a valence electron controller. As the valence electron controller for obtaining the p-type semiconductors, compounds containing a Group III element are used. As the Group III element, there are included B, Al, Ga, and In. As the valence electron controller for obtaining the n-type semiconductors, compounds containing a Group V element are used. As the Group V element, P, N, As, and Sb are included.

As the method for film formation of the amorphous silicon semiconductor layers, there are used the methods known in the art such as evaporation, sputtering, RF plasma process, microwave plasma CVD process, ECR process, thermal CVD process, LPCVD process, and so on, according to the necessity. Further, for obtaining the layers of a large area, a method is used in which film formation is carried out while continuously conveying the substrate by the roll-to-roll method.

The present invention can be applied not only to production of cells having only a single semiconductor junction, but also to production of the so-called tandem cells having two or more semiconductor junctions, or the triple cell as shown in FIG. 3, for the purpose of improving the spectral sensitivity or voltage.

<Transparent Electrode Layer 304>

The transparent electrode layer 304 is an electrode for taking out the electromotive force generated in the semiconductor layers 303, 313, 323, which is paired with the lower electrode layer 302 and is also called an upper electrode. The transparent electrode layer is necessary in the case of a semiconductor with a high sheet resistance, such as the amorphous silicon based solar cell. Further, since the electrode layer 304 is located on the light incidence side, it needs to be transparent.

The transparent electrode layer 304 desirably has the transmittance of light of not less than 85% in order to efficiently absorb light from the sun, a fluorescent tube, or the like in the semiconductor layers 303, 313, 323. Further, from the electrical aspect, the transparent electrode layer 304 needs to have a low sheet resistance in order to allow the current generated by light to flow in a direction parallel to the semiconductor layers 303, 313, 323, and the sheet resistance is preferably not more than 100 Ω.

The materials having the above-stated characteristics include metal oxides such as $SnO_2$, $In_2O_3$, ZnO, CdO, $CdSnO_4$, ITO, and so on, which are suitably used as a material for the transparent electrode layer 304.

<Collector Electrode 305>

The collector electrode 305 is provided for taking out the electromotive force generated in the semiconductor layers 303, 313, 323, by the transparent electrode layer 304 and then collecting it. The collector electrode 305 is formed in a comb shape, and the suitable width, pitch, etc. thereof are designed or determined depending upon the value of the sheet resistance of the transparent electrode layer 304. The collector electrode 305 is required to have so low a resistivity as not to establish a series resistance of the solar cell.

As the method for forming the collector electrode 305, there are specifically included a method for mixing powdered metal of Ag, Ni, Al, Ti, Cr, W, Cu, or the like with a polymer binder and a solvent to form a paste and forming the electrode by the screen printing, a method for directly forming the electrode by evaporation, the soldering method, the plating method, a method for installing wires of the aforementioned metals, and so on.

(Defect Treatment of Photovoltaic Element)

Figure 5:
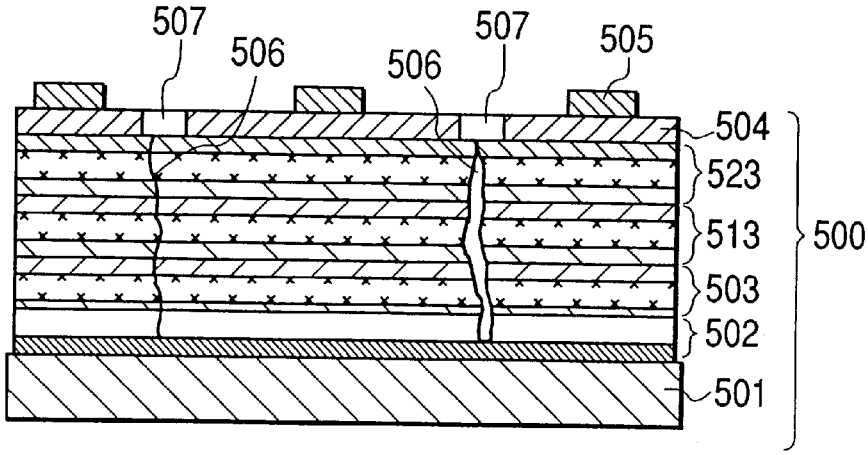
FIG. 5 is a schematic, sectional view diagrammatically showing a solar cell that experienced the defect treatment according to the present invention.

FIG. 5 is a sectional view of a photovoltaic element 500 the defects of which have been treated. In FIG. 5, numeral 501 denotes the substrate, 502 the lower electrode layer, 503 the bottom cell, 513 the middle cell, 523 the top cell, 504 the transparent electrode layer, 505 the collector electrode (grid electrode), 506 defect portions, and 507 portions that were made to have a higher resistance.

In general, the total thickness of the semiconductor layers 503, 513, 523 deposited is as thin as 4000 Å. When there exists a projection, a particle, or the like above or below the semiconductor layers, it is difficult to fully cover them by deposition.

For example, when stainless steel is used as the substrate 501 and the semiconductor layers 503, 513, 523 are continuously deposited thereon, it is difficult to eliminate all projections, depressions, and distortion even by smoothing treatment of the surface of substrate 501. Further, during conveyance in continuous film formation, not a few indentations and flaws will be mechanically made from the back surface side of the substrate 501. Therefore, defect portions will be produced because of 1 $\mu$m or more asperities and mechanical damage to the semiconductor layers 503, 513, 523.

For example, if there is a projection with a large height from the surface of the substrate 501, the semiconductor layers 503, 513, 523 will fail to cover the substrate 501 and the lower electrode layer 502, so that the transparent electrode layer 504 will be stacked directly on the substrate 501 or the lower electrode layer 502 in contact therewith, causing a shunt or short. Further, if dust or the like is laid during film formation of the semiconductor layers 503, 513, 523, portions which lack the semiconductor layers 503, 513, 523 will be formed or peeling off thereof will occur, which will be the cause of pinholes or will result in stacking of the transparent electrode layer 504 directly on the lower electrode layer 502 or the substrate 501, thus causing a shunt or short.

Existence of these defects affects the voltage characteristics under a low illumination intensity. Specifically, the photo-induced current of the photovoltaic element linearly increases with increasing illumination intensity, but the resultant voltage increases exponentially. More specifically, there appears little difference in the voltage irrespective of the degree of defects under a large illumination intensity, e.g., under a strong light source with the brightness of about 100 mW/cm$^2$ in the extreme case. However, there appears a difference in the voltage between those with and without the defects as the illumination intensity becomes small. This tendency becomes more outstanding from the illumination intensity of 1000 Lux or less. It is thus important to eliminate the influence due to the defects indoor or in environments where the sunlight is hard to be collected.

According to the defect treating method of the present invention, by forming the high-resistance portions 507 in part of the transparent electrode layer 504 above the defect portions 506 of the semiconductor layers 503, 513, 523 in the photovoltaic element 500, the current paths to the defect portions 506 are closed. On this occasion, since the high-resistance portion forming treatment of the transparent electrode layer 504 is carried out only in the vicinity of the defect portions 506, the resistivity itself of the transparent electrode layer 504 is not increased. Therefore, the series resistance of the whole photovoltaic element is not increased.

Figure 6:
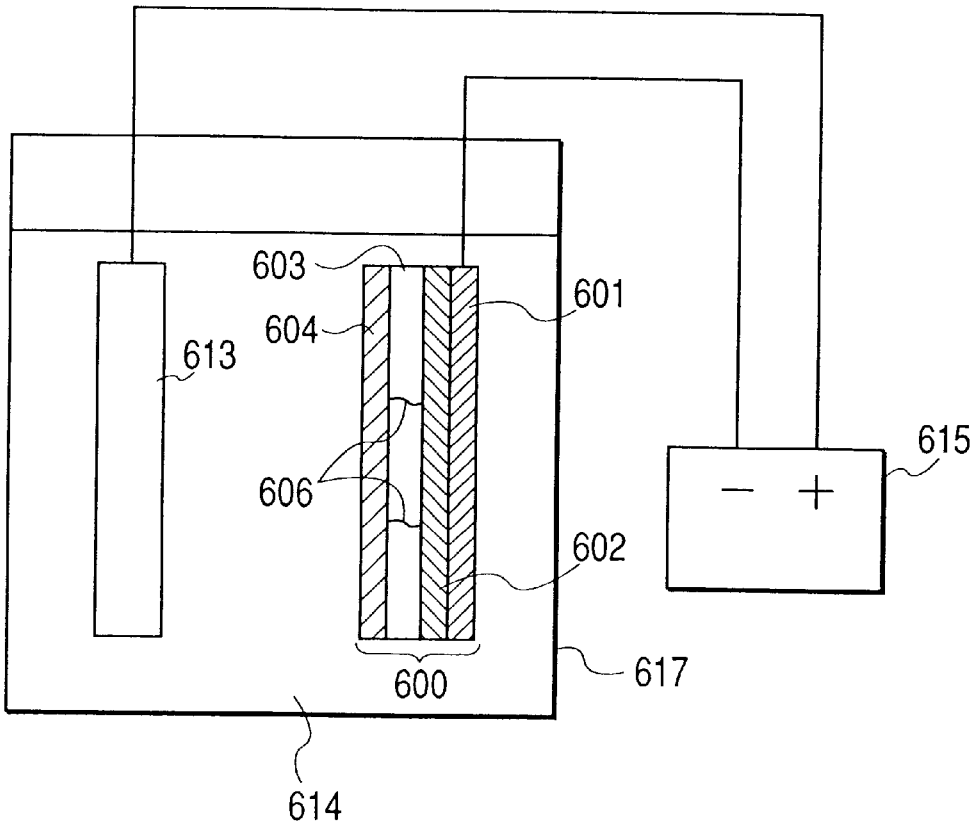
FIG. 6 is a schematic view showing a defect treating apparatus according to the present invention.

FIG. 6 illustrates an example of a defect treating apparatus according to the present invention. Numeral 600 designates the photovoltaic element, 601 the substrate, 602 the lower electrode layer, 603 the semiconductor layer in which the p-layer is deposited as the topmost layer (on the left side in the figure), 604 the transparent electrode layer, 606 the defect portions, 617 the electrolytic cell, 614 the electrolyte, 613 the counter electrode (etching electrode), and 615 the power source.

In the present invention, the formation of the high-resistance portions 507 in FIG. 5, described above, is achieved by reducing a part of the transparent electrode layer 604. The photovoltaic element 600 is immersed in the electrolytic cell 617 and is connected to the negative electrode side of the power source 615, and the etching electrode 613 is connected to the positive electrode side. That is, a bias voltage is thus applied in the forward direction to the photovoltaic element 600. When the bias is applied between the electrodes in this arrangement, the current flows preferentially through the defect portions 606 of a low resistivity via the medium of electrolyte 614.

At this time, nascent hydrogen is generated on the photovoltaic element 600 side, which is the cathode side, to bring about a chemical reaction with the periphery of the defect portions 606, i.e., the transparent electrode layer 604 formed above the defect portions 606. Namely, the transparent electrode layer 604 comprised of a metal oxide is reduced. At the same time as this reducing reaction, dissolution of the reaction product into the electrolyte 614 starts and the transparent electrode layer 604 is missed in the dissolved portions, which results in substantially interrupting paths of leak current flowing laterally into the defects via the transparent electrode layer 604. The amount of oxygen generated at this time differs depending on the type or concentration of the electrolyte, and the type or fabrication conditions of the transparent electrode layer 604.

According to the present invention, the bubbles generated during the defect treatment can be decreased and it becomes possible to form the high-resistance portion only above the vicinity of the defect portion. Since the high-resistance portion is formed in a very small area, the influence to the series resistance can be reduced; further, the number and size of spot-like portions becomes small; therefore, the yield can be increased not only in terms of the performance but also in terms of the appearance.

Incidentally, the above-stated electrolysis can also be performed by irradiating the photovoltaic element 600 with light, in the electrolyte. On this occasion the voltage itself generated by the photovoltaic element 600 with the light becomes the bias, and the bias condition can be controlled by the intensity of the light as radiated.

EXAMPLES

The present invention will be described in further detail with examples thereof, but it should be noted that the present invention is by no means intended to be limited to these examples.

Example 1

Using the electrolytic etching apparatus shown in FIG. 1C, patterning by etching of a transparent conductive film was carried out.

In this example, a Pt plate having the thickness of 0.8 mm was used as the work electrode 112 forming the etching electrode 111, a plate of SUS 304 having the thickness of 2.0 mm as the auxiliary electrode 113, and a glass-epoxy resin sheet having the thickness of 0.2 mm as the insulating material 114 in combination. At this time the electrode surface (which is the surface closest to the etching object 101 during the electrolytic etching) was smoothed by polishing.

First, the SUS 304 substrate of 31 cm×31 cm square, after fully degreased and cleaned, was put in an evaporation apparatus and an ITO film was deposited thereon in the thickness of 750 Å, thereby making the etching object 101.

Then, the etching electrode 111 and the etching object 101 were set in the electrolytic cell 107. On that occasion, the ITO film side of the etching object 101 was opposed to the smoothed surface of the etching electrode 111. The work electrode 112 was connected as an anode side to the power source 105 while the auxiliary electrode 113 and the etching object 101 were connected as the cathode side to the power source 105. Further, a butt spacer of Teflon was mounted to adjust the gap between the etching electrode 111 and the etching object 101 to 0.4 mm.

As the electrolyte 104, an aqueous solution of sulfuric acid was used. The concentration was adjusted to 1.0% by weight and the electric conductivity to 25 mS/cm. As the additive, was added polyethylene glycol with the molecular weight of 400 by 1.0% by weight, and the solution was stirred sufficiently. The contact angle of the electrolyte to the surface of the etching object 101 was measured by a wettability measuring device (CONTACT-ANGLE METER, mfd. by Kyowa Kaimen Kagaku Kabushiki Kaisha) to be 56°. The power source 105 as used was a dc power source. The controller 106 was used to make adjustment so as to allow a constant current of 20 A to flow for 0.2 sec, and the electrolytic treatment was carried out. A hundred samples were etched in the same manner. During the electrolysis the evolution of gas from the surface of the etching object 101 was observed. After the electrolytic treatment, the patterned, uneven surface of the etching electrode 111 was observed from the side to find no residence of bubbles thereon.

After that, the etching object 101 was taken out of the electrolyte 104, washed with pure water, dried, and thereafter observed by an optical microscope with the result that the etching object was uniformly patterned in 30 cm×30 cm square and in the line width of 0.2 mm. Further, the defective etching such as chipping was not observed even at the etched portion (corner) of the pattern.

Comparative Example 1

For comparison's sake, patterning by etching of a transparent conductive film was carried out in the same manner as in Example 1 except that the additive was not added to the electrolyte 107.

The contact angle of the electrolyte was measured to be found to be 87°. When the evolution of gas from the surface of the etching object 101 during the electrolysis was observed, a lot of very large bubbles were observed to be generated. Further, after the electrolysis treatment, the patterned, uneven surface of the etching electrode 111 was observed from the side, and it was clear that the bubbles staying on the surface increased with increasing number of etching treatments.

After that, the etching object 101 was taken out of the electrolyte 107, washed with pure water, then dried, and thereafter observed by an optical microscope with the result that the average width of the patterning lines was 0.2 mm±0.1 mm, showing dispersion. Further, portions where a line was not formed in part (disconnection) were observed with increasing number of etching treatments. In addition, chipping and rounding were observed at the etched portion of the pattern.

Example 2

A hundred samples were patterned by the electrolytic etching of the transparent conductive film in the same manner as in Example 1 except that the additive added to the electrolyte was polypropylene glycol. The polypropylene glycol used as the additive was one having the molecular weight of 400 and the amount of the additive was 1.0% by weight.

In this example, the contact angle of the electrolyte 107 was measured to be 44°. After the electrolysis treatment, the etching object 101 was taken out of the electrolyte 107, washed with pure water, dried, and thereafter observed under an optical microscope. The result was that a uniform pattern was also formed in 30 cm×30 cm square and in the line width of 0.2 mm±0.05 mm as in the case of Example 1. Further, the defective etching such as chipping was not observed even at the etched portion (corner) of the pattern.

Example 3

A hundred samples were patterned by the electrolytic etching of the transparent conductive film in the same manner as in Example 1 except that the additive added to the electrolyte was ethanol. The amount of the ethanol used as the additive was 9.0% by weight.

In this example, the contact angle of the electrolyte 107 was measured to be 50°.

After the electrolysis treatment, the etching object 101 was taken out of the electrolyte 107, washed with pure water, dried, and thereafter observed by an optical microscope with the result that a uniform pattern was also formed in 30 cm×30 cm square and in the line width of 0.2 mm±0.05 mm as in the case of Example 1. Further, the defective etching such as chipping was not observed even at the etched portion (corner) of the pattern.

Example 4

A hundred samples were patterned by the electrolytic etching of the transparent conductive film in the same manner as in Example 1 except that the additive added to the electrolyte was a surfactant.

The surfactant used as the additive was a fluorocarbon surfactant (of the structure of $RfSO_3K$; Rf: $C_nF_{2n+1}$-) and the amount of the additive was 0.1% by weight.

In this example, the contact angle of the electrolyte 107 was measured to be 28°.

After the electrolysis treatment, the etching object 101 was taken out of the electrolyte 107, washed with pure water, dried, and thereafter observed by an optical microscope. The result was that a uniform pattern was also formed in 30 cm×30 cm square and in the line width of 0.2 mm±0.05 mm as in the case of Example 1. Further, the defective etching such as chipping was not observed even at the etched portion (corner) of the pattern.

Example 5

A hundred samples were patterned by the electrolytic etching of the transparent conductive film in the same manner as in Example 1 except that the electric current applied during the electrolytic treatment was of the pulse shape.

The power source 105 was a pulse power source and the pulse current of 0.05 A having the pulse width of 0.2 sec was applied twenty times at the intervals of 0.1 sec.

After the electrolysis treatment, the etching object 101 was taken out of the electrolyte 107, washed with pure water, dried, and thereafter observed by an optical microscope with the result that etching lines were obtained in 30 cm×30 cm square and in the line width of 0.2 mm on average. Further, the defective etching such as chipping was not observed even at the etched portion (corner) of the pattern.

Example 6

On the occasion of fabrication of the amorphous solar cell having the pin junction type triple cell structure as shown in FIG. 3, patterning by etching of the transparent electrode layer was carried out using the electrolytic etching apparatus shown in FIG. 1C. The details will be described below.

First, after sufficient ultrasonic cleaning with acetone and isopropanol, a substrate 301 of stainless steel (SUS430BA) 0.15 mm thick and 360 mm wide in a roll form was put in a DC magnetron sputtering apparatus; a layer of Ag was deposited at room temperature in the thickness of 0.4 $\mu$m on the surface of the substrate; and ZnO was then deposited at the substrate temperature 350° C. in the thickness of 0.4 $\mu$m, thereby forming the lower electrode layer 302 of a two-layer structure.

Then, the substrate was taken out of the DC sputtering apparatus, and an n-type semiconductor layer, an i-type semiconductor layer, and a p-type semiconductor layer were formed in this order to form the bottom cell 303 thereon by the following method. The following method was repeated in the same manner to form the middle cell 313 and the top cell 323, thus forming the semiconductor layer.

The inside of depressurizable deposition chambers (vacuum chambers) was depressurized to a predetermined initial pressure. Into the deposition chambers were introduced a source gas $SiH_4$ and a dilution gas $H_2$ and the chambers were evacuated by a vacuum pump. Here, $BF_3$ was used as a dopant gas for attaining the p-type semiconductor layer (other dopant gases can also be used), and $PH_3$ was used as a dopant gas for attaining the n-type semiconductor layer (other dopant gases can also be used). The substrate temperature was controlled by heaters. On the occasion of deposition of the i-type semiconductor layer, microwaves oscillated by a microwave power supply were guided by a hollow waveguide and introduced through a dielectric window (alumina ceramic was used in this example) into the deposition chamber. The frequency of the microwaves was 2.45 GHz; the substrate temperature in the deposition chamber was 300° C.; the internal pressure was 10 mTorr; and the power was 0.1 W/cm$^3$. Further, on the occasion of deposition of the n-type semiconductor layer and the p-type semiconductor layer, RF high-frequency waves were applied to the flat electrode. The frequency of the RF high-frequency waves was 13.45 MHz; the substrate temperature in the deposition chambers was 200° C.; the internal pressure was 1 Torr; and the RF power was 0.01 W/cm$^3$.

The thicknesses of the layers were as follows; in the bottom cell 303, the n-type semiconductor layer 250 Å, the i-type semiconductor layer 1050 Å, and the p-type semiconductor layer 100 Å; in the middle cell 313, the n-type semiconductor layer 600 Å, the i-type semiconductor layer 1450 Å, and the p-type semiconductor layer 100 Å; in the top cell 323, the n-type semiconductor layer 100 Å, the i-type semiconductor layer 1000 Å, and the p-type semiconductor layer 100 Å.

Next, on the substrate with the semiconductor layer formed thereon, there was formed an ITO film as the transparent electrode layer 304 by use of the DC magnetron sputtering method (the film forming temperature 170° C.; the film thickness 730 Å). This transparent electrode layer 304 has an antireflection function. The substrate on which the layers up to the transparent electrode layer 304 have been formed will be called hereinafter a solar cell.

Figure 2:
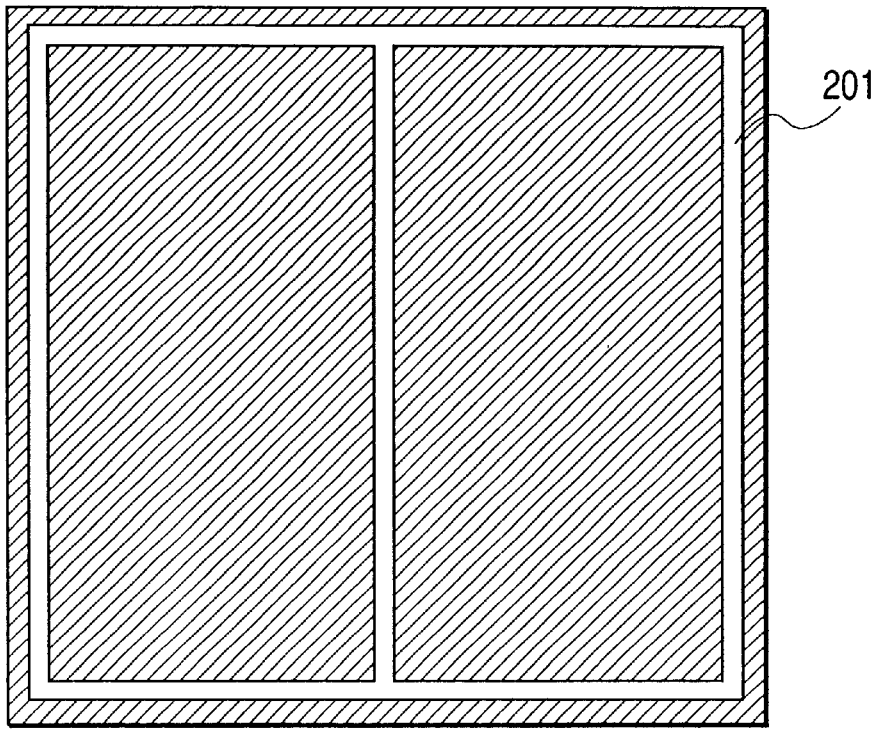
FIG. 2 is a schematic view showing an example of an etching pattern where etching was conducted using the electrolytic etching apparatus shown in FIGS. 1A, 1B and 1C.

Then, the solar cell substrate was cut in the size of 360 mm×260 mm and the transparent electrode layer 304 was patterned as shown in FIG. 2 by the same method as in Example 1 by use of the electrolytic etching apparatus shown in FIG. 1C. Numeral 201 denotes an etching line.

Subsequently, copper wires coated with a carbon paste were placed at the pitch of 5 mm and were thermocompressed at 200° C. for one minute to form the collector electrode 305 on the transparent electrode layer 304, thereby obtaining the solar cell 300 as shown in FIG. 3. A hundred solar cells were produced by the same method. The initial characteristics of these solar cells 300 were evaluated as follows.

First, the voltage-current characteristics in a dark state were measured and the shunt resistance was determined from the slope in the vicinity of the origin. The average shunt resistance was 100 kΩ·cm$^2$, so that there occurred no shunt. Further, the substrate surface after the etching treatment was analyzed by XMA apparatus and no residual elements of the additive were recognized.

Figure 4A:
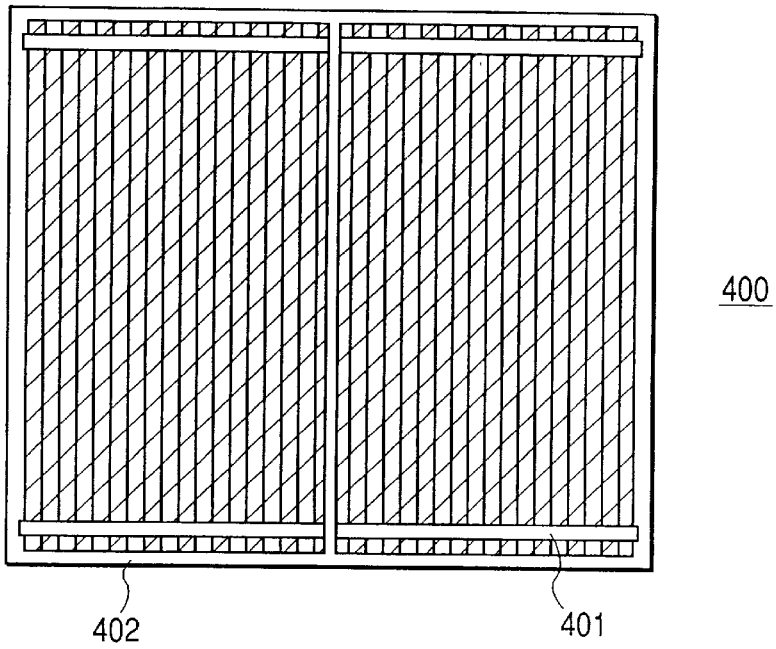
FIGS. 4A and 4B are schematic views diagrammatically showing examples in which the solar cell produced according to the present invention is cut into two cells and the two cells are connected in series.

Then, the solar cell 300 was divided on the center line by a press cutter as shown in FIG. 4A, thereby obtaining solar cells 400 having the half area. The shunt resistances of the respective solar cells 400 after the division were measured and the average thereof was 98 kΩ·cm$^2$. Thus there was no shunt even after the division. The solar cell characteristics were measured using a solar simulator (mfd. by SRIRE Inc.) with the global sunlight spectra of 1.5 AM at a dose of 100 mW/cm$^2$, and the photoelectric conversion efficiency was determined with the result that the obtained average value was as good as 9.0% ±0.2%.

Further, when the portions patterned by the electrolytic etching were observed by an optical microscope, it was confirmed that uniform etching lines were obtained without disconnection nor defective etching.

Figure 4B:
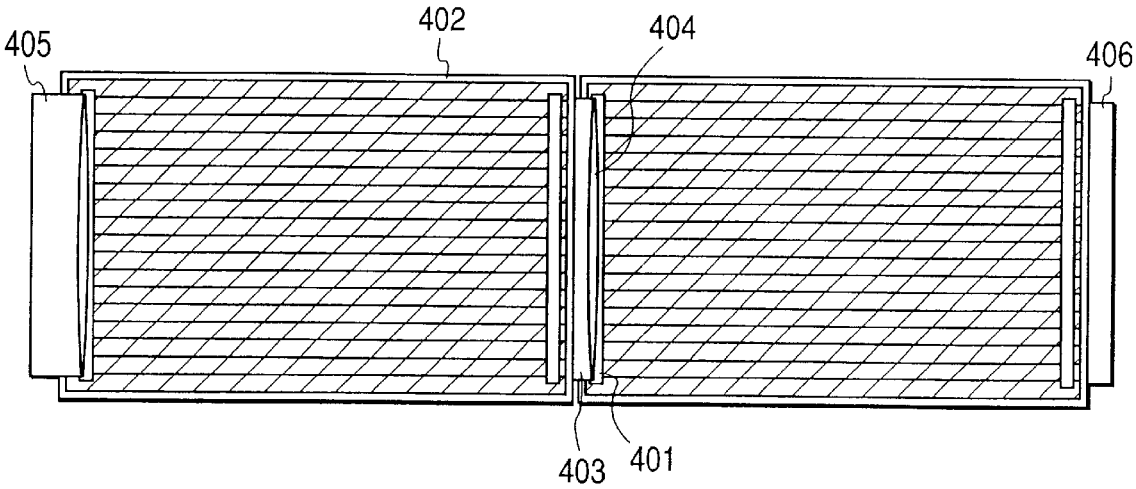

Then, the solar cells 400 obtained by the division were connected in series as shown in FIG. 4B. At this time, the series connection was achieved by use of a copper foil 403, and a solder 404 was used for the plus collecting portion 401 of the right solar cell and for the minus stainless steel portion 402 of the left solar cell. Further, a plus lead-out electrode 405 was soldered to the collecting portion of the left solar cell while a minus lead-out electrode 406 to the stainless steel portion of the right solar cell. These series-connected solar cells were laminated to form a module as follows. First, an insulation film having EVA (ethylene-vinyl acetate) resin on the both surfaces, a non-woven fabric of glass, the above solar cells, an EVA resin sheet, and a fluororesin film were stacked on a 55% aluminum zinc alloy coated steel sheet, and they were laminated by thermocompression bonding using a vacuum laminating apparatus.

Further, this module of solar cells (hereinafter referred to as a solar cell module) experienced the reliability test based on the temperature-humidity cycle test A-2 defined in the environmental test method and durability test method for crystalline solar cell modules in Japanese Industrial Standard C8917.

First, the solar cell module was put in a thermo-hygrostat capable of controlling the temperature and humidity and a cycle test to change the temperature between −40° C. and +85° C. was repetitively carried out twenty times. The photoelectric conversion efficiency of the solar cell module after the test was measured by the above-stated method to obtain an average photoelectric conversion efficiency of 98.0% of the initial value. Further, when visually observed, no peeling was found of the semiconductor layer of the solar cells or the laminating agent.

As described above, in this example, good patterning accuracy can be obtained by etching and solar cells with excellent initial characteristics and reliability can be fabricated.

Example 7

In fabrication of the amorphous solar cell having the pin junction type triple cell structure as shown in FIG. 5, patterning by etching of the transparent conductive film was carried out using the electrolytic etching apparatus shown in FIG. 1C in the same manner as in Example 6 and thereafter the defect treatment was carried out using the defect treating apparatus shown in FIG. 6.

The electrolyte used in the defect treatment was the same as in Example 6 and the electrolysis conditions were set by sequence control of the dc power source so that a direct current of 4.5 V was applied for two seconds. After that, the solar cell 600 as patterned was taken out of the electrolyte 614, washed with pure water, and dried.

Subsequently, copper wires coated with a carbon paste were placed at the pitch of 5 mm and thermocompressed at 200° C. for one minute to form the collector electrode 505 on the transparent electrode layer 504, thereby obtaining the solar cell 500 as shown in FIG. 5. A hundred solar cells were fabricated by the same method.

The initial characteristics of these solar cells 500 were evaluated by the same method as in Example 6 to obtain better values of the average shunt resistance 698 $k\Omega \cdot cm^2$ and the average conversion efficiency 9.4%±0.2%. Further, there was no extreme spot-like portion as observed by visual observation.

As described above, according to the present invention, it is possible to carry out patterning with excellent selectivity even of a precise pattern without being affected by the bubbles evolving during the electrolytic etching. Further, the invention can simplify the steps of the etching treatment.

In addition, according to the present invention, it is possible to provide a photoelectric conversion element with good characteristics overcoming the issues of shunt, defective appearance, and so on.

Further, according to the present invention, since the defect treatment of a photovoltaic element is carried out by the electrolytic etching treatment, it becomes possible to achieve defect treatment in a non-contact manner and with less damage to the photovoltaic element.

What is claimed is:

1. An electrolytic etching method comprising etch treating an object to be etched by an electrochemical reaction through an electrolyte between the object to be etched and an etching electrode, wherein said etching electrode comprises a work electrode and an auxiliary electrode adjacent to each other and separated by an insulating material which forms a boundary therebetween, wherein said work electrode and said auxiliary electrode each form a pattern, and wherein the contact angle of the electrolyte to the object to be etched is not more than 70°.

2. The electrolytic etching method according to claim 1, wherein the contact angle of the electrolyte to the object to be etched is not less than 10°.

3. The electrolytic etching method according to claim 1, wherein the electrolyte contains an additive substance to lower the surface tension of the electrolyte.

4. The electrolytic etching method according to claim 3, wherein the content of the additive substance is 0.01–10% by weight.

5. The electrolytic etching method according to claim 3, wherein the additive substance is at least one selected from the group consisting of polyethylene glycol, polypropylene glycol, acetylenic alcohol, ethanol, and copolymers thereof, and surfactants.

6. The electrolytic etching method according to claim 1, wherein a patterning processing is carried out by the etching treatment.

7. The electrolytic etching method according to claim 6, wherein a mask is provided on the object to be etched and a portion of the object not covered by the mask is etched.

8. The electrolytic etching method according to claim 6, wherein the etching electrode is a patterned electrode.

9. The electrolytic etching method according to claim 1, wherein the electrolyte contains a Lewis acid or a Lewis base.

10. The electrolytic etching method according to claim 1, wherein the electrolyte is an aqueous solution.

11. The electrolytic etching method according to claim 1, wherein energization is achieved by allowing a direct current, a pulse current, or an alternating current to flow between the etching electrode and the object to be etched.

12. The electrolytic etching method according to claim 1, wherein after completion of the etching treatment, a water washing treatment and a thermal treatment of the object to be etched are carried out.

13. The electrolytic etching method according to claim 1, wherein the object to be etched is a substrate on which a transparent electroconductive film is deposited.

14. The electrolytic etching method according to claim 1, wherein the object to be etched is a substrate for a photovoltaic element having at least one of a metal layer and a transparent electroconductive film.

15. The electrolytic etching method according to any one of claims 1 to 12, wherein the object to be etched is a photovoltaic element comprising a semiconductor layer provided on a substrate and a transparent electrode layer provided on the semiconductor layer.

16. A method for producing a photovoltaic element comprising a semiconductor layer provided on a substrate and an electroconductive layer provided on the semiconductor layer, comprising the step of etching the electroconductive layer by the electrolytic etching method as set forth in any one of claims 1 to 12.

17. The method for producing a photovoltaic element according to claim 16, wherein the electroconductive layer is a transparent electrode layer.

18. A method for treating a defect of a photovoltaic element comprising a semiconductor layer provided on a substrate and an electroconductive layer provided on the semiconductor layer, and having a short-circuit path of electrically short-circuiting the electroconductive layer and the substrate through the semiconductor layer, the method comprising the step of reducing the electroconductive layer in the periphery of the short-circuit path by the electrolytic etching method as set forth in any one of claims 1 to 12.

19. The method for treating a defect of a photovoltaic element according to claim 18, wherein the electroconductive layer is a transparent electrode layer.

* * * * *